US005540205A

United States Patent [19]

Davis et al.

[11] Patent Number: 5,540,205

[45] Date of Patent: Jul. 30, 1996

[54] AIR FUEL RATIO CONTROL

[75] Inventors: Robert M. Davis, North Beach; Darren A. Smith, Doubleview; Ian R. Thompson, Duncraig, all of Australia

[73] Assignee: Orbital Engine Company (Australia) Pty. Limited, Balcatta, Australia

[21] Appl. No.: 284,432

[22] PCT Filed: Feb. 11, 1993

[86] PCT No.: PCT/AU93/00058

§ 371 Date: Jan. 17, 1995

§ 102(e) Date: Jan. 17, 1995

[87] PCT Pub. No.: WO93/16278

PCT Pub. Date: Aug. 19, 1993

[30] Foreign Application Priority Data

Feb. 11, 1992 [AU] Australia ..... PL-0790

[51] Int. Cl.[6] ..... F02M 51/00

[52] U.S. Cl. ..... 123/486

[58] Field of Search ..... 123/486, 417, 123/416, 480, 422, 423, 492, 493, 478, 399; 364/431.05, 431.04

[56] References Cited

U.S. PATENT DOCUMENTS

| | | | |
|---|---|---|---|
| 4,932,371 | 6/1990 | Albertson et al. | 123/73 |
| 4,960,097 | 10/1990 | Tachibana et al. | 123/486 |
| 5,339,784 | 8/1994 | Fukui | 123/417 |
| 5,341,786 | 8/1994 | Abe et al. | 123/486 |
| 5,349,933 | 9/1994 | Hasegawa et al. | 123/486 |

FOREIGN PATENT DOCUMENTS 0239095 9/1987 European Pat. Off. .

*Primary Examiner*—Raymond A. Nelli

[57] ABSTRACT

A method of controlling the mass of air and fuel delivered to an internal combustion engine per cylinder, per cycle, by utilizing a unique control algorithm.

11 Claims, 2 Drawing Sheets

AIR FUEL RATIO CONTROL

This invention relates to the controlling of the air fuel ratio of the combustion mixture for a fuel injected internal combustion engine. In the specification, the reference to air fuel ratio is in relation to the overall air fuel ratio for each engine cycle and does not refer to air fuel ratio at any particular location within the combustion chamber of the engine.

Conventional homogeneous charge internal combustion engines normally utilise an air-fuel delivery system in which the amount of air flowing to the engine is controlled by the operator and the amount of air-flow inturn determines the amount of fuel to be delivered to the engine. Thus the amount of air flowing to the engine directly determines the power output of the engine. This is true for both carburetted and fuel injected systems. For example, with a typical fuel injected system an air-flow meter is employed to determine the amount of air flowing to the engine. The fuel to be injected to the engine is then determined by reference to, inter alia, the measured air-flow.

However, with recent developments in internal combustion engine technology there is a tendency to stratify the air-fuel mixture within the combustion chamber. This is particularly true of some two-stroke cycle engines. When a stratified charge mixture is utilised there will be an excess of air within the combustion chamber which will not be involved in the combustion process. Thus the total amount of air flowing to the engine is, in general, not directly related to the engine power output as is the case for a homogeneous charge engine. In such a case it is desirable to de-couple the fuel flow to the engine from the air flow to the engine so that the air and fuel flows can be independently controlled. One such method of achieving this de-coupling is known as a Drive-By-Wire (DBW) system with engine fuel control.

In a conventional DBW system the operator does not directly control the air or the fuel but merely generates a signal ("demand" signal) which indicates the operators requirements (eg. increase or decrease in power output from the engine). This demand signal may then be processed by an Electronic Control Unit (ECU) which controls the air flow and which in turn determines the fuel flow requirements of the engine. By incorporating an engine fuel control function to the conventional DBW system the ECU controls the fuel flow which in turn determines the air flow requirements of the engine. Although such a system satisfies the required need for de-coupling it has certain disadvantages.

The applicants co-pending Australian Patent Application No. 51065/90, which is hereby incorporated by reference, describes a partial DBW system with engine fuel control or "hybrid" DBW system. In this system there is a direct mechanical linkage to a main air throttle and an ECU controlled by-pass of the main throttle. The by-pass is of such proportions that it can supply the entire air flow to the engine at low loads and speeds but cannot supply the entire air flow required at high loads and speeds. Thus, the sizing of the by-pass, which is not mechanically linked to the driver, is such that if some excursion in the normal control of the by-pass did occur it would not lead the engine to enter into a high power output operating region which could be dangerous. Furthermore, apart from the cost and weight advantages the hybrid system also provides increased accuracy since the resolution in the control function is increased as only a part of the total air flow area is being affected, and improved responsiveness due to the lower inertia of moving parts due to their smaller size.

With this hybrid system the ECU controlled by-pass can, in the low load region of engine operation, fully control the air flow to the engine. As the load demand on the engine is increased the mechanically operated main throttle will allow some air flow to the engine. When this occurs the by-pass can be used as a trimming device to provide the desired amount of air-flow to the engine. This facility is discussed more fully in our co-pending application noted above.

Thus this hybrid DBW system, in an ideal situation, can provide a means by which the air and fuel flow to an engine can be independently controlled. However, as will be appreciated the amount of control of air afforded by the by-pass diminishes as the main throttle opening increases. Thus, if for instance the engine was being operated in a region of low atmospheric pressure and/or was suffering from a restriction in the air flow path to the engine (eg: blocked air filter) the mass of air flow to the engine would be reduced and the by-pass would be called upon to allow additional air to the engine. However, if the conditions of low atmospheric pressure and/or flow path restriction are sufficiently severe, the by-pass even when fully opened will be insufficient to supply the required amount of air flow to the engine. A similar limitation will result if the engine is operated in abnormally high atmospheric pressures resulting in the mass of air flowing to the engine being too high.

These limitations can in some engine operating conditions result in an air fuel ratio which is undesirable from the point of view of specific operating requirements of the engine, such as the control of misfiring of the combustion charge due to an over rich or over lean mixture, or the risk of overheating of the catalyst or other factors particularly those relating to the control of exhaust emissions.

It is therefore the object of the present invention to provide a method of controlling the air fuel ratio of the combustion charge delivered to an internal combustion engine in order to ensure that the air fuel ratio of the combustion charge is within pre-set limits to prevent the creation of adverse combustion conditions.

With this object in view there is provided a method of controlling the mass of air and fuel delivered to an internal combustion engine per cylinder per cycle comprising determining the required fuel per cycle for delivery to the engine in response to engine operating conditions, setting the air supply to the engine to provide the required air/fuel ratio for the determined fuel per cycle at said operating conditions, determining the actual air supply to the engine, and adjusting the fuel per cycle so the actual air/fuel ratio is within predetermined limits from the required air/fuel ratio.

More specifically the method includes determining the required fuel per cycle in response to engine operational conditions, determining the required air per cycle in response to said required fuel per cycle and engine operating conditions, adjusting the air flow to the engine in response to said required air per cycle, determining if the actual air flow to the engine, is within set limits of said required air flow and if not adjusting said required fuel per cycle in accordance with the actual air flow.

Preferably, the limits of air/fuel ratio of any particular engine operating conditions is the richest air fuel/ratio acceptable for those operating conditions. Conveniently a look-up map is provided in the electronic engine management system with preset air/fuel ratio against engine speed and load. The map can be arranged with the preset air/fuel ratio selected to prevent a specific engine malfunction such as engine misfire, catalyst and/or emission considerations.

Since the correction of the air/fuel ratio can be based on various requirements as mentioned above, it may not be appropriate to use the same requirement to set the correct air/fuel ratio throughout the entire engine operating range. For example, depending upon the engine speed the fuel per cycle may reach a maximum value at a load below the full load capable of demand from the operator. Under such conditions it may be highly desirable to set the air/fuel ratio so as to maintain good emissions control. However, at actual full load demand of the operator, it may be more important to attain maximum power so that a richer air/fuel ratio can be tolerated. As a further example, it may be beneficial to set the air/fuel ratio in accordance with catalyst temperature requirements.

In the light of the above, it is therefore appropriate to provide a specific map for wide open throttle, this map being selected by an input signal responsive to wide open throttle operation. The signal can be provided by a sensor responsive to the driver demanding wide open throttle operation, such as a sensor operated by the driver actuated throttle pedal. It is to be noted that in many engine environments, the control of emissions at wide open throttle may be less stringent and a richer air/fuel ratio is acceptable.

In an engine having a main throttle controlled air supply and a by-pass air supply, such as is disclosed in the Applicant's previously referred to patent application, adjustment or correction of the air/fuel ratio can be achieved by the operation of the by-pass air supply. However, when the degree of adjustment is beyond the capacity of the by-pass air supply the correction of the air/fuel ratio is effected by adjustment of the fuel per cycle. This of course will also be true for a DBW system with engine fuel control where even wide open throttle operation will not provide sufficient air flow at a particular operator demand which is below full load demand. Thus, where an engine management system includes an ECU controlled by-pass air supply, it is preferred that adjustment of the air/fuel ratio by control of the fuel per cycle, is only implemented within a predetermined range of engine operation, being a range wherein the operation of the by-pass air supply has limited influence on the rate of total air supply. This range is preferably based on the rate of air supply and can be determined by the level of air supply to the engine by the by-pass air supply and/or the total air supply (being the sum of the bypass air supply and the main air supply) or can be achieved by detecting when the throttle or like valve element of the by-pass air supply system reaches a predetermined degree of opening or closing, thus providing an indication of whether or not the bypass valve is in a range where its influence on the air supply is insufficient.

The invention will be more readily understood from the following description of one practical application of the present invention to control the air fuel ratio of an engine. The following description is specifically related to controlling the air fuel ratio to an engine operating on the two stroke cycle, however, it is to be understood that the invention is equally applicable to four stroke cycle engines.

In the accompanying drawings.

Figure 1:
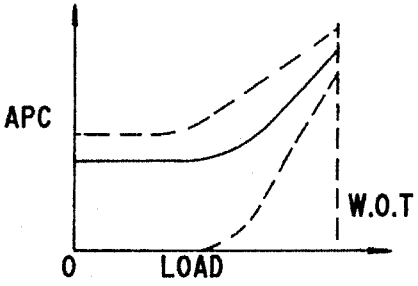
FIG. 1 is a graphic representation of the typical requirement relative to lead for a two stroke cycle engine.
Figure 2:
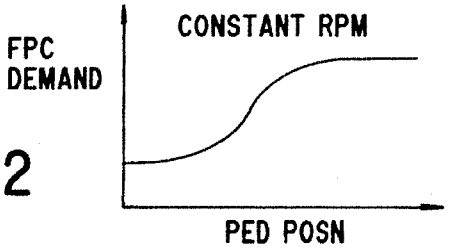
FIG. 2 is a graph of fuel demand with respect to lead.

Referring now to FIG. 1, it will be noted that as the lead increases, the air per cycle initially remains substantially steady in the low lead range and then increases at a progressively greater rate as the engine lead moves through the medium to high lead range. The dotted lines on either side of the full line indicate the range of variation in air per cycle that can be achieved by a secondary or bypass air supply operating in conjunction with the normal throttle. It is to be noted that as the air per cycle increases in the medium to high lead range, the extent of adjustment that can be achieved by the use of the air bypass is progressively decreased.

A typical form of throttle valve and secondary air supply system that functions in the manner illustrated in and described with reference to FIG. 1 is described in more detail in Australian Patent Application No. 51065/90. It will therefore be seen that for any particular lead and throttle setting a significant variation in air per cycle can be obtained by use of the secondary air supply resulting in a corresponding range of air fuel ratios.

Figure 3:
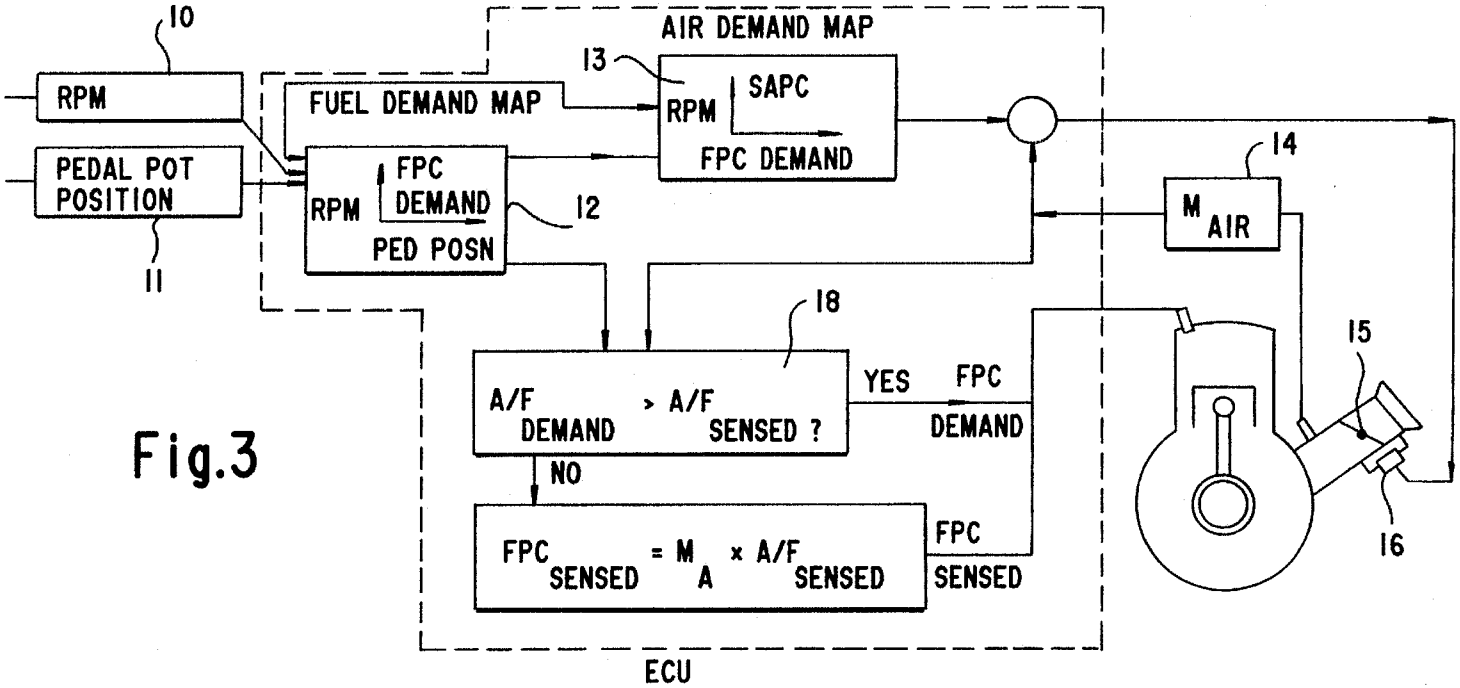
FIG. 3 is a diagrammatic representation of the control system in accordance with the present invention.
Figure 4:
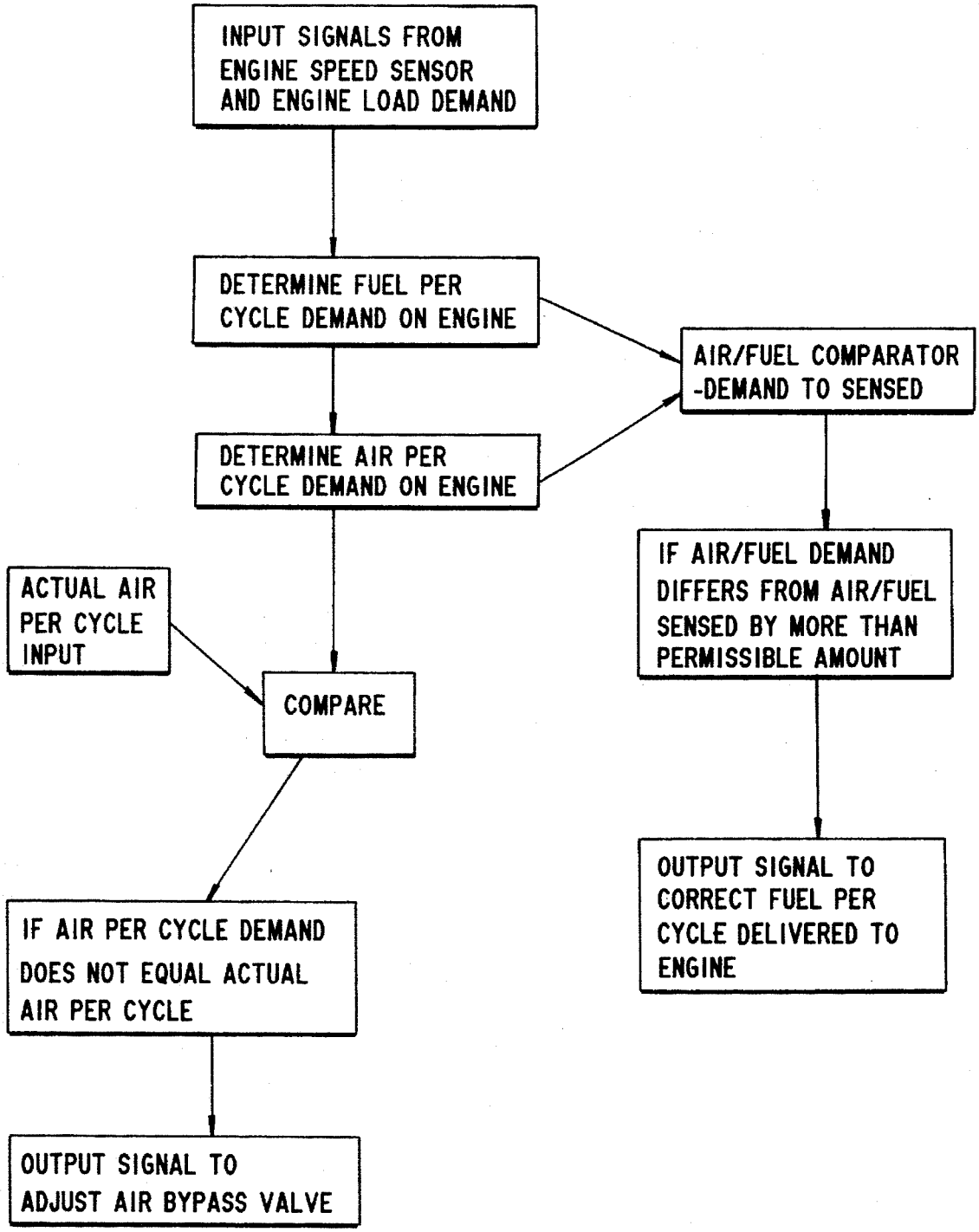
FIG. 4 is a flowchart of the operation of the ECU.

Referring now to FIG. 3 of the drawings, there is depicted diagrammatically the method of operation of an engine management system to control the air fuel ratio in the manner above discussed. The portion of the diagram within the dotted outline consists of part of an electronic control unit operating an engine management system, such ECU controlled management systems being well known in the art. The ECU receives signals indicating the engine speed from the sensor 10 and the engine lead demand from the sensor 11, the latter being indicated by the position of a potentiometer attached to the driver operated throttle pedal. Based on these signals, the demand map 12 produces a signal indicating the fuel per cycle demand of the engine. The signal indicating the fuel per cycle demand of the engine is supplied to the air demand map 13 which determines the air per cycle demand for that particular fuel per cycle demand having regard to the engine speed. The air mass sensor 14 measures the actual air per cycle being delivered to the engine for the current position of the throttle valve 15 and bypass valve 16 and if the air per cycle demand as indicated from the air demand map 13 does not correspond with the actual air per cycle being delivered to the engine, the air bypass valve 16 is activated to effect the necessary correction.

The fuel per cycle demand and actual air per cycle signals are also provided as inputs to an air/fuel ratio comparator 18, wherein the actual air/fuel ratio based on these inputs is compared with a censored air/fuel ratio which is preset on the basis of engine lead demand position and engine speed. The censored air/fuel ratios are stored in a map and will normally be a range between maximum or minimum predetermined limits.

If the air fuel ratio, as determined by the demand fuel per cycle and the actual air per cycle, differs from the censored air/fuel ratio by more than the permissible amount, then a correction will be made to the fuel per cycle delivered to the engine, so that the air/fuel ratio will be within the permissible variation from the censored air fuel ratio. In the example shown, the censored air/fuel ratio (A/F censored) is set on the basis of rich misfire and hence, so long as the air fuel ratio based on FPC demand and actual air flow (i.e. A/F Demand) is greater than A/F censored the engine will be protected from rich misfire. The correction is made by way of adjustment of the fuel per cycle as other operating parameters of the engine are commonly related to the fuel per cycle delivered, such as spark advance, injection timing and injection duration and will therefore also adjust in response to the adjustment of the fuel per cycle to provide correct combustion conditions.

A map may be provided for determining the censored air fuel ratio for the fuel per cycle demand and engine speed and corrective action will be taken if the inputs indicate that the operation of the engine is not within the permitted tolerance of the censored air fuel ratio, which tolerance may be in the form of any air fuel ratio above a designated ratio and/or any air fuel ratio below a designated ratio. The program that effects the comparison of the measured air fuel ratio with the censored air fuel ratio in the map is preferably arranged so that it is possible to interpolate between specific air fuel ratios recorded in the map.

It is to be appreciated that in certain engine operating conditions, there may be a continuing over or under supply of air to the engine such as at high altitude operation and/or due to blockages in the air supply, such as a dirty air filter, and the control system above discussed can be adapted to adjust for such conditions. Accordingly, if the control system detects that it is continually necessary to correct the air/fuel ratio in a particular direction, that is to increase or decrease the ratio, then upon sensing such conditions, the program can be arranged to reset the fuel per cycle map which is based on engine speed and engine lead demand so that in effect the map reads a throttle pedal position less than the actual position. This condition can be detected by integration of the error in the air supply controller over a period of time. The practical affect of this is to cause the operator to depress the accelerator pedal further thus, opening the main throttle further but without actually demanding more fuel.

The censored values of the air/fuel ratio may also be adaptive over time, such that if abnormal running conditions are sensed (for instance with a combustion chamber pressure transducer able to detect rich misfire) the ECU may recognise this and alter the sensed A/F values so that further occurrence of this is reduced. It is also envisaged that the censored air/fuel ratio values could be automatically incremented either upwards or downwards over time (preferably using a long time constant) until the onset of predetermined running conditions are sensed at which point further incrementation is delayed. After a suitable period, this process may repeat.

The description of the practical application of the invention with reference to the drawings is by reference to an engine operating on the two stroke cycle and it is to be understood that, although the invention is particularly advantageous as applied to such engines, it is also applicable to four stroke cycle engine.

What is claimed is:

1. A method of controlling the mass of air and fuel delivered to an internal combustion engine per cylinder per cycle comprising:

determining the required amount of fuel per cycle for delivery to the engine in response to engine operating conditions;

setting the air supply to the engine to provide the required air/fuel ratio for the determined amount of fuel per cycle at said operating conditions;

determining the actual air supply to the engine, and adjusting the amount fuel per cycle delivered by a fuel injector so the actual air/fuel ratio is within predetermined limits of the required air/fuel ratio.

2. A method as claimed in claim 1 wherein the required amount of air per cycle is determined in response to said amount of fuel per cycle and engine operating conditions, the air flow to the engine is adjusted in response to said determined amount of air per cycle and determining if the actual air flow to the engine is within set limits of said required air flow and, if not, adjusting said required amount of fuel per cycle in accordance with the actual air flow.

3. A method as claimed in claim 1 wherein the method is implemented by an electronic engine management system programmed with a look-up map having pre-set air/fuel ratios for given engine speed and load conditions.

4. A method as claimed in claim 1 wherein said predetermined limits of the required air/fuel ratio are set to prevent a specific engine malfunction.

5. A method as claimed in claim 1 wherein said predetermined limits of the required air/fuel ratio are set to avoid differing engine malfunction throughout the operating range of the engine.

6. A method as claimed in claim 1 wherein a specific look-up map is provided for wide open throttle.

7. A method as claimed in claim 6 wherein said specific look-up map is selected by an input signal responsive to wide open throttle.

8. A method as claimed in claim 1 wherein the air supply to the engine to provide the required air/fuel ratio is a by-pass air supply.

9. A method as claimed in claim 1 wherein requited air/fuel ratio is adjusted in accordance with a condition selected from the group consisting of high-altitude engine operation and filter blockage.

10. A method as claimed in claim 1 wherein a fuel per cycle map is provided which is adapted to be reset in response to continued sensed changes in an engine operating condition.

11. A method as claimed in claim 1 wherein sensed values of said air/fuel ratio are adaptive over time.

* * * * *